US006712029B1

(12) United States Patent
Andersson et al.

(10) Patent No.: US 6,712,029 B1
(45) **Date of Patent: *Mar. 30, 2004**

(54) CYLINDER FOR AN INTERNAL COMBUSTION ENGINE

(76) Inventors: Lars Andersson, Sjömilsgatan 16, S-421 37 Västra Frölunda (SE); Pär Martinsson, Ravingatan 10B, S-556 28 Jönköping (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/482,987

(22) Filed: Jan. 14, 2000

(30) Foreign Application Priority Data

Jan. 19, 1999 (SE) ..... 9900138

(51) Int. Cl.[7] ..... F02F 1/22

(52) U.S. Cl. ..... 123/73 R

(58) Field of Search ..... 123/73 R, 65 A, 123/65 P, 73 PP, 74 R

(56) References Cited

U.S. PATENT DOCUMENTS 968,200 A 8/1910 Scott
980,134 A 12/1910 Springer (List continued on next page.)

FOREIGN PATENT DOCUMENTS

AT 394755 B 11/1991

(List continued on next page.)

OTHER PUBLICATIONS

Prof.Dr.H.P.Lenz, Dipl.Ing.G.Bruner, Dipl.Ing. F. Gerstl, Abschluβbericht, zum Forschungsauftrag sur Entwicklung eines Ladungswechselverfahrens mit Spülvorlage für Motorfahrräder, Mar. 1978, pp. 1–16, Tables I–III, Bild 1–17, Z–NR. B0644, Institut für Verbrennungskraftmaschinen und Kraftfahrewsen. Technische Unviersität Wien.

Dipl.–Ing. Friedrich Gerstl, Dissertation, Massnahmen Zur Abgas–und Verbrauchsverbesserung von Kleimvolumigen Zweitakt–Ottomotoren, ausgefuhrt sum Zwecke, der Erlangung des akademischen Grades eines Doktors der technischen Wissenschaften, eingereicht an der Technischen Universitat in Wein, Aug. 1979.

(List continued on next page.)

*Primary Examiner*—Henry C. Yuen
*Assistant Examiner*—Hyder Ali
(74) *Attorney, Agent, or Firm*—Howrey, Simon, Arnold & White LLP

(57) ABSTRACT

The invention refers to a cylinder (1) for a two-stroke, crankcase scavenged combustion engine, comprising an inlet pipe (10) for air/fuel mixture, at least one transfer port (17), and at least one outer connecting port (18) intended to be connected to a connecting duct (not shown), whereby the outer connecting port (18) is arranged so that it can be connected to the mentioned transfer port (17) via a piston ported air passage.

The outer connecting port (18) is located below the inlet pipe (10) and at least one wall passage (14) extends from the mentioned outer connecting port (18), obliquely upwards through the cylinder wall, to at least one connecting port (16).

This design enables the cooling air to flow freely around the cylinder above the inlet pipe (10), which improves the cooling of the cylinder.

17 Claims, 3 Drawing Sheets

U.S. PATENT DOCUMENTS

| | | | | | |
|---|---|---|---|---|---|
| 1,113,456 | A | | 10/1914 | McIntosh | |
| 1,121,584 | A | | 12/1914 | Harper | |
| 2,317,772 | A | | 4/1943 | Huber et al. | |
| 4,067,302 | A | | 1/1978 | Ehrlich | |
| 4,075,985 | A | | 2/1978 | Iwai | |
| 4,176,631 | A | | 12/1979 | Kanao | |
| 4,248,185 | A | | 2/1981 | Jaulmes | |
| 4,253,433 | A | | 3/1981 | Blair | |
| 4,306,522 | A | | 12/1981 | Fotsch | |
| 4,340,016 | A | * | 7/1982 | Ehrlich | 123/73 R |
| 4,481,910 | A | | 11/1984 | Sheaffer | |
| 4,969,425 | A | | 11/1990 | Slee | |
| 4,987,864 | A | * | 1/1991 | Cantrell et al. | 123/65 BA |
| 5,379,732 | A | | 1/1995 | Mavinahally et al. | |
| 5,425,346 | A | | 6/1995 | Mavinahally | |
| 5,645,026 | A | | 7/1997 | Schlessmann | |
| 5,857,450 | A | | 1/1999 | Staerzl | |
| 6,016,776 | A | * | 1/2000 | Jonsson | 123/65 A |
| 6,085,703 | A | | 7/2000 | Noguchi | |
| 6,112,708 | A | | 9/2000 | Sawada et al. | |
| 6,216,650 | B1 | | 4/2001 | Noguchi | |
| 6,240,886 | B1 | | 6/2001 | Noguchi | |
| 6,289,856 | B1 | | 9/2001 | Noguchi | |

FOREIGN PATENT DOCUMENTS

| | | | |
|---|---|---|---|
| DE | 420100 | | 10/1925 |
| DE | 470603 | | 1/1929 |
| DE | 748415 | | 11/1944 |
| DE | 749456 | | 11/1944 |
| DE | 2 151 941 | | 4/1973 |
| DE | 26 50 834 | | 6/1977 |
| DE | 3329791 | A1 | 2/1985 |
| DE | 37 22 424 | | 1/1988 |
| DE | 19857738 | A1 | 7/1999 |
| EP | 0 337 768 | | 10/1989 |
| EP | 0 391 793 | | 10/1990 |
| EP | 0971110 | A1 | 1/2000 |
| EP | 0997620 | A2 | 5/2000 |
| FR | 784866 | | 7/1935 |
| FR | 1434710 | | 5/1965 |
| GB | 2 022 699 | | 5/1979 |
| GB | 2 130 642 | | 7/1983 |
| JP | 57183520 | A | 11/1982 |
| JP | 58-005423 | | 1/1983 |
| JP | 07269356 | | 10/1995 |
| JP | 2000170611 | | 6/2000 |
| JP | 2000328945 | | 11/2000 |
| JP | 2000337154 | | 12/2000 |
| WO | WO 89 02031 | A1 | 3/1989 |
| WO | WO98/57053 | * | 12/1998 |
| WO | WO 00 65209 | A1 | 11/2000 |
| WO | WO 00 43650 | A1 | 12/2000 |
| WO | WO 01 25604 | A1 | 4/2001 |
| WO | WO 01 44634 | A1 | 6/2001 |

OTHER PUBLICATIONS

J. Meyer, Air–Head Charge Stratification Of A Two–Stroke Outboard Engine, Mar. 1992, The Queen's University of Belfast, School of Mechanical & Manufacturing Engineering.

Dr. R. Pischinger, 5$^{th}$ Graz Two–Wheeler Symposium, Apr. 22–23, 1993, Heft 65, Technische Universitat Graz, Mitteilungen des Institutes fur Verbrennungskraftmaschinen und Thermodynamik, Belfast, Ireland.

Patent Abstracts of Japan, Crank Chamber Compression 2–Cycle Internal Combustion Engine, appl. No. 56102519, appl. date Jun. 1981.

Patent Abstract of Japan, Device for preventing mixture from Blowing Through Two–cycle Engine, appl. No. 56–69216, appl. date Jun. 1981.

WO98/57053, Stratified Scavenging Two–Cycle Engine, Dec. 1998.

Blume, K., Zweitakt–Gemischspülung mit Spülvorlage. IN: MTZ Motortechnische Zeitschrift 74 (1972), pp. 475–479.

Lanchester, FW and Pearsall RH, The Institution of Automobile Engineers, An Investigation of Certain Aspects of the Two–Stroke Engine for Automobile Vehicles. IN: The Automobile Engineer, Feb. 1922, pp. 55–62.

* cited by examiner

CYLINDER FOR AN INTERNAL COMBUSTION ENGINE

TECHNICAL FIELD

The subject invention refers to a cylinder for a two-stroke, crankcase scavenged internal combustion engine, comprising an inlet pipe for air/fuel mixture, at least one transfer port, and at least one outer connecting port intended to be connected to a connecting duct, whereby the outer connecting port is arranged so that it can be connected to the mentioned transfer port via a piston ported air passage.

Thus, fresh air is added at the upper part of the scavenging ducts and is intended to serve as a buffer against the air/fuel mixture below. When the scavenging takes place, this air buffer is largely lost out into the exhaust outlet, thus reducing the fuel consumption and exhaust emissions.

TECHNICAL BACKGROUND

Engines of the above mentioned type have ducts for fresh air designed with connecting ports in the cylinder, usually one on each side of the piston. The air flow between these connecting ports and the scavenging ducts is controlled by the position of the piston by means of a recess in the piston, which in a defined piston position connects the connecting ports and the scavenging ducts' scavenging ports in the cylinder. In order for this piston control to function, it is necessary that the connecting ports are positioned at a defined distance above the inlet port.

According to known technology, which for instance is illustrated in WO98/57053, cylinders in engines of this type have therefore been designed with one or several air ducts positioned above the inlet pipe. However, this positioning, which is closer to the combustion chamber then the inlet pipe, entails that the air inlet in this case is subjected to a relatively high temperature with air expansion and reduced delivery rate as a result. Furthermore, the air inlet disturbs the cooling air, which usually can flow unimpeded around the cylinder above the inlet tube, with an even higher temperature as a result.

In accordance with another known variant, which is also illustrated in WO98/57053, the air inlet is designed with two air ducts, one on each side of the inlet. In this case, the inlet has been located higher than usual, and to prevent the inlet being blocked by the piston, an aperture has been made in the piston, which allows a passage for the air/fuel mixture down into the crankcase, even when the piston's lower edge is positioned below the inlet. Consequently, this solution requires a considerably more complicated piston design.

SUMMARY OF THE INVENTION

The purpose of the subject invention is to create a cylinder to which it is possible to add fresh air to the scavenging ducts without causing the problem mentioned above.

This purpose is achieved according to the subject invention by means of a cylinder of the type mentioned initially, where an outer connecting port is located below the inlet tube and that at least one passage extends from the outer connecting port, obliquely upwards through the cylinder wall, to at least one connecting port.

In relation to the inlet pipe, the mentioned connecting port is located so that a satisfactory control of the air supply by the piston to the scavenging ducts is possible.

This design enables the cooling air to flow freely around the cylinder above the inlet tube, which improves the cooling of the cylinder. Furthermore, the fresh air is not subjected to the higher temperatures which prevail above the inlet pipe, since the wall passages pass from below and past the inlet pipe through the material of the cylinder wall.

Further advantageous cooling of the fresh air is obtained by means of the close contact with the inlet, where each passage winds itself around the inlet pipe and is consequently cooled as a result of this.

In accordance with a preferred embodiment, the cylinder comprises two wall passages, which pass one on each side of the inlet pipe.

The two wall passages can be joined in a common outer connecting port, which in that case is located immediately below the inlet tube. This embodiment can be achieved with a minimal amount of material resulting in a light and inexpensive cylinder.

Each scavenging port is preferably located slightly above the corresponding connecting port, which entails that the fresh air at the passage between the connecting ports and the scavenging ports is made to flow obliquely upwards. The location of the air inlet, according to the subject invention, therefore gives the fresh air an advantageous flow direction for the piston ported air passage, i.e. obliquely upwards, whereby unnecessary directional changes of the fresh air flow is eliminated.

The inlet pipe is preferably directed obliquely downwards towards the cylinder. The wall passages, which are directed obliquely upwards and which pass the inlet tube, thereby pass the inlet pipe at a greater angle, preferably almost at a right angle, which results in an even further reduction of material consumption. Furthermore, the obliquely downwards directed inlet pipe is favourable, since the air/fuel mixture taken in is made to flow down into the crankcase and consequently improve the lubrication of the big end bearing.

BRIEF DESCRIPTION OF THE DRAWINGS

The subject invention will be described in closer detail in the following with reference to the accompanying drawing figures, which for the purpose of exemplification show a preferred embodiment of the invention.

DESCRIPTION OF A PREFERRED EMBODIMENT

Figure 1:
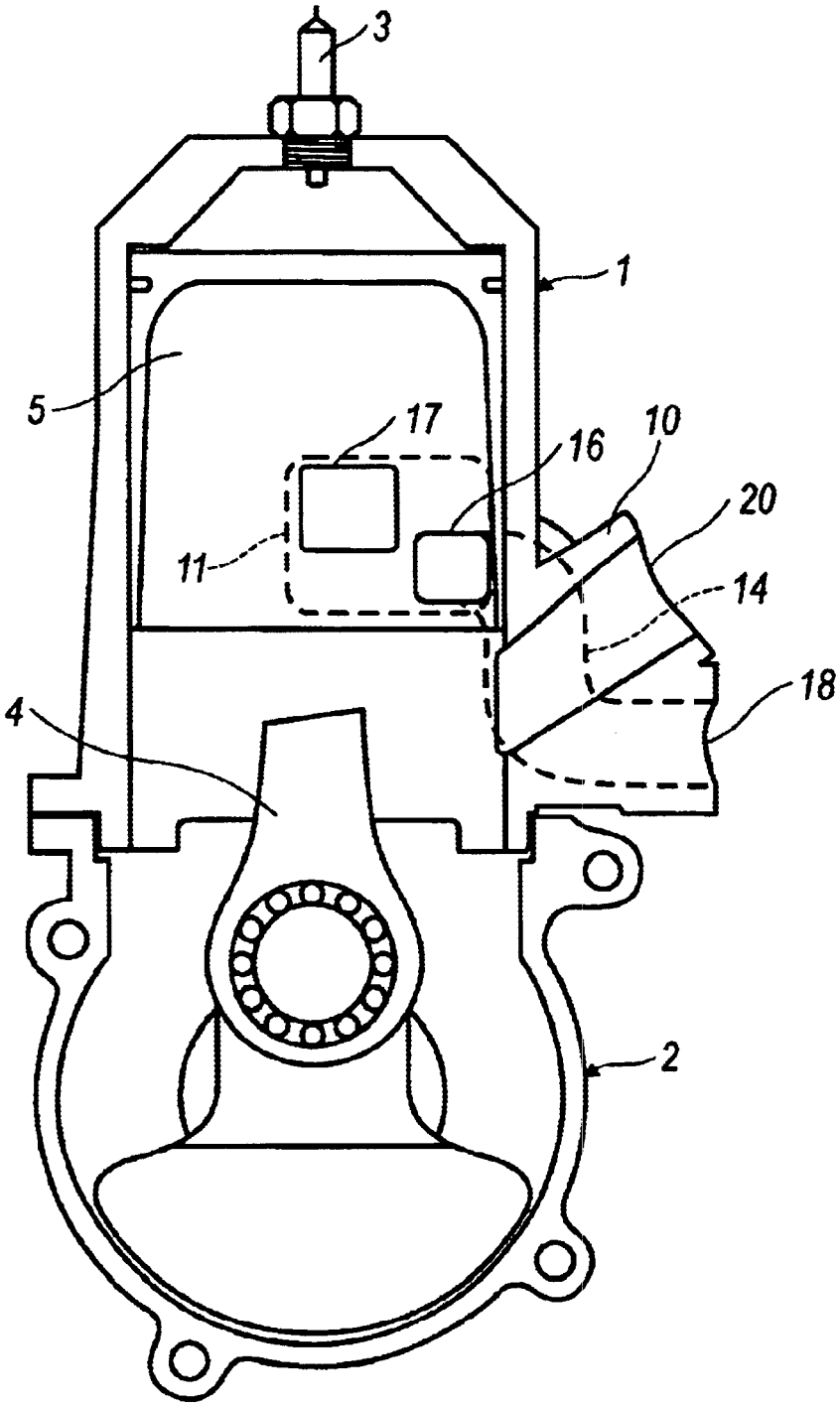
FIG. 1 is a basic outline of an engine with a cylinder in accordance with an embodiment of the invention.

A cylinder 1 is shown schematically in FIG. 1 in accordance with an embodiment of the invention, which cylinder is mounted on a crank case 2. A spark plug 3 is arranged at the top of the cylinder. A part of the connecting rod 4 can be seen in the crankcase and a part of the piston 5 can be seen in the cylinder. These parts are not shown in their entirety so that the components more closely related to the invention can be seen more clearly. Naturally, the cylinder also has an exhaust outlet connected to a muffler, which are not at all illustrated in the figures for the sake of clarity.

It should also be noted that the cylinder's position throughout the subject description shows the crankcase connection facing downwards and the spark plug's attachment point directed upwards. No major variations should normally occur concerning this orientation, however, this orientation shall still not be regarded as a restriction of the subject invention, which rather refers to the relative design of the cylinder's various parts.

Furthermore, the cylinder 1 is equipped with an inlet pipe 10, through which the air/fuel mixture is supplied to the cylinder from a carburettor (not illustrated). The cylinder 1 also has one or several wall passages 14 for supply of fresh air. Each wall passage 14 exits on the inside of the cylinder wall in a connecting port 16. In accordance with the invention, each wall passage 14 is orientated obliquely downwards in relation to the connecting port 16, and extends past the inlet pipe 10 to an outer connecting port 18 on the outside of the cylinder, which is located below the mouth 20 of the inlet pipe.

Furthermore, the cylinder has at least one scavenging port 17, which leads to a scavenging duct (not shown). The scavenging duct can be shaped radially out from the cylinder in a conventional way.

The cylinder's interaction with the engine's remaining, but not illustrated parts (e.g. carburettor, scavenging ducts, exhaust outlet and muffler etc.), is regarded as so well known to the skilled man that a more detailed description of these parts and their function as a whole is superfluous.

Figure 2:
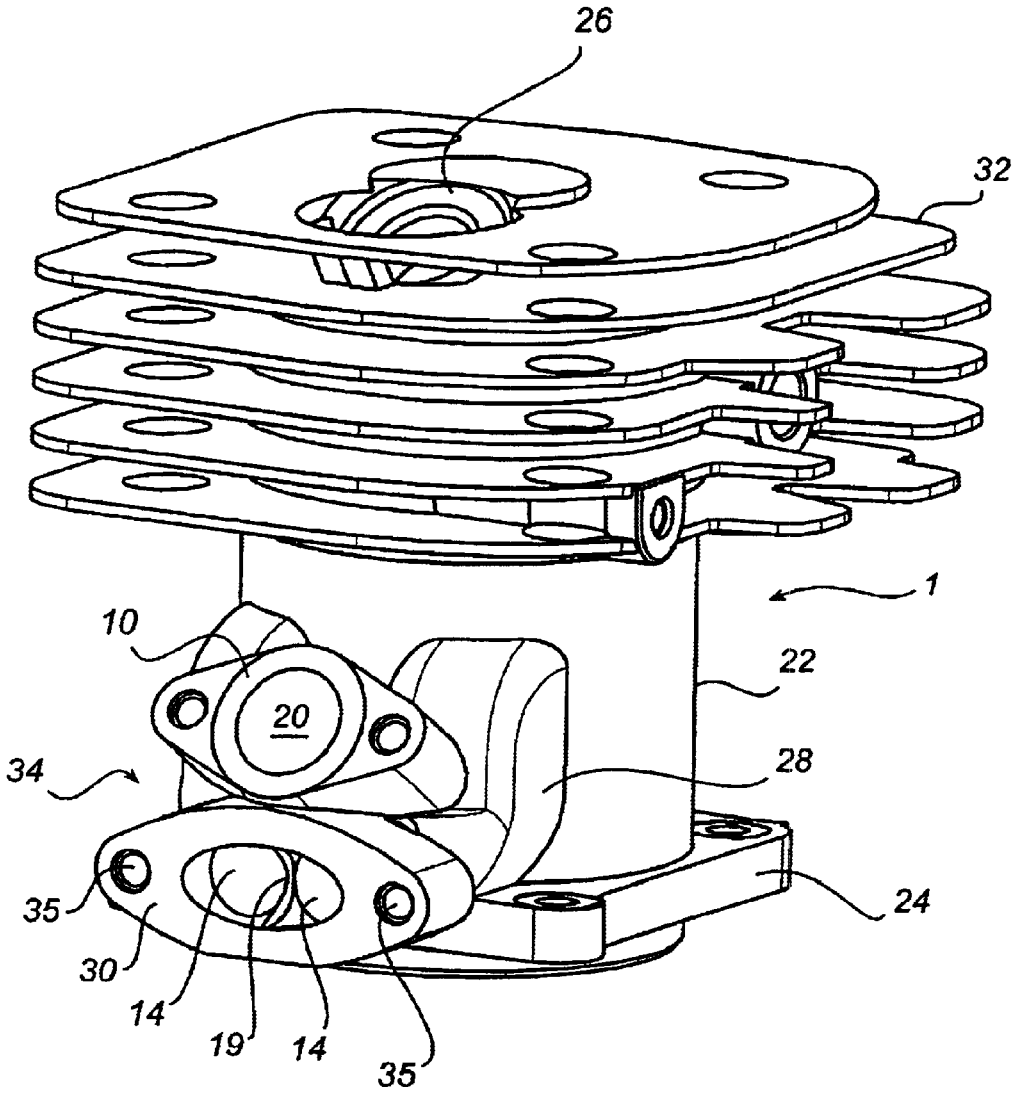
FIG. 2 illustrates by means of a perspective drawing a cylinder in accordance with a preferred embodiment of the invention.
Figure 3:
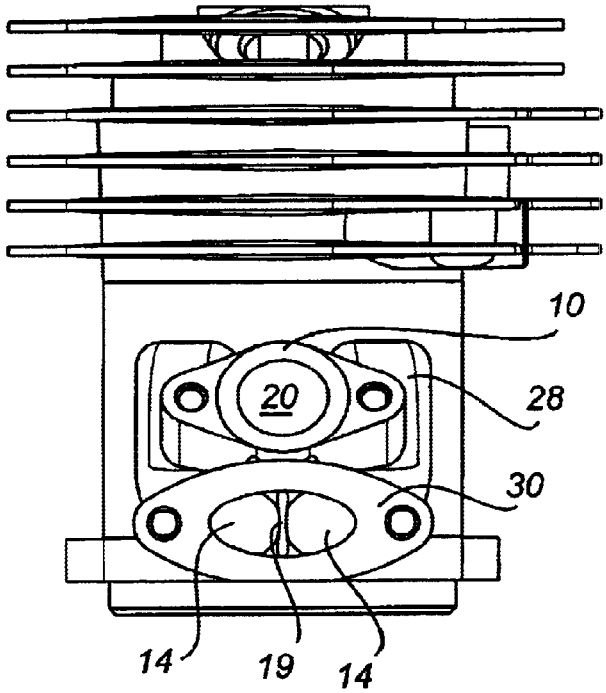
FIG. 3 illustrates the cylinder in FIG. 2 from the front.
Figure 4:
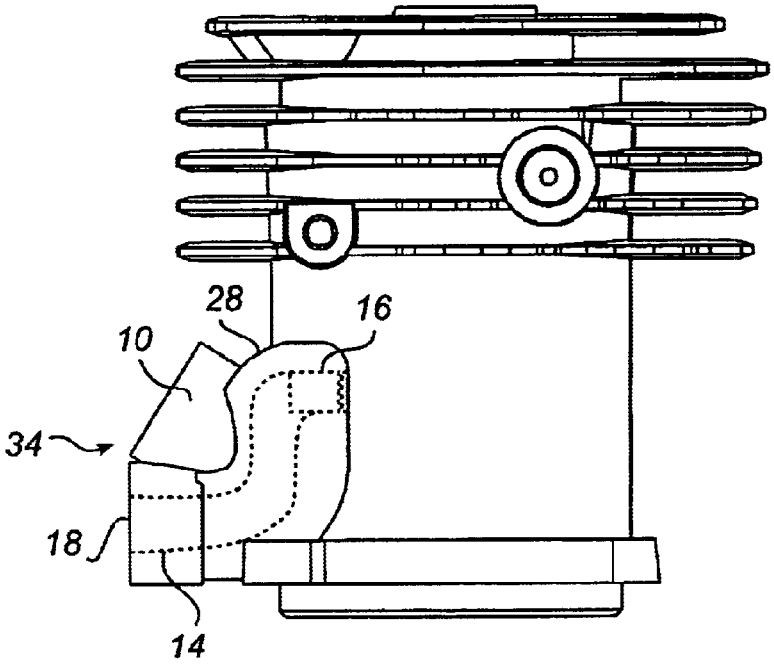
FIG. 4 illustrates the cylinder in FIG. 2 from the side.

FIGS. 2–4 show the cylinder in FIG. 1 (still without scavenging ducts) in perspective as well as plane views from the front and the side.

The cylinder, which is shown in FIG. 2, comprises an essentially cylindrical body 22, which has a flange 24 at its lower part intended to be attached to the engine's crankcase 2 as well as having an attachment point 26 for the spark plug 3, in its top part.

In the illustrated example, the cylinder 1 has two wall passages 14, which are cast into the cylinder's material 28 and pass on each side of the inlet pipe 10. Both wall passages 14 join in a common outer connecting port 18 below the inlet pipe 10. A partition wall 19 separates the passages. The common outer connecting port is surrounded by a flange 30 for the connection of a connecting duct (not shown).

As illustrated in FIGS. 2–4, the cylinder 1 has a number of cooling fins 32, distributed along the entire height of the cylinder. However, for the sake of clarity, only the fins on the cylinder's upper half are shown.

The entire cylinder 1 is preferably cast in one piece, even though a cylinder consisting of several different parts would be possible. The outer connecting port 18 and the inlet pipe 10 thereby form a relatively integrated unit in the form of a protruding section 34 from the cylindrical body 22. A device is established in this unit 34, e.g. tapped holes 35, for the connection of a connecting duct to the outer connecting port 18 as well as of a carburettor to the inlet pipe 10.

In the illustrated example, the inlet pipe 10 is directed obliquely upwards from the cylinder, while the outer connecting port 18 as well as the first part of the passage immediately inside the outer connecting port 18, are directed essentially perpendicularly to the cylinder.

It is especially evident from FIG. 2 how the wall passages 14 wind around the inlet pipe 10 and pass it at almost a right angle. As a result of this design, the amount of material needed in the protruding section 34 becomes relatively small.

It is evident that a number of modifications of the embodiment as described above are possible within the scope of the enclosed patent claims. For example, the exact path of the wall passages 14 through the material can vary as well as the dimensions and the angles of the inlet, passages and ports.

What is claimed is:

1. A cylinder (1) for a two-stroke, crankcase scavenged internal combustion engine, including an inlet pipe (10) for air/fuel mixture, at least one transfer port (17), and at least one outer connecting port (18), wherein the outer connecting port (18) is connected to the transfer port (17) via a piston-ported air passage (11), the outer connecting port (18) is located below the inlet pipe (10), and at least two wall passages (14), one each extending on each side past the inlet pipe (1), and each wall passage (14) extending from an outer connecting port (18) obliquely upwards through the cylinder wall, to at least one connecting port (16).

2. The cylinder as recited in claim 1, wherein the wall passages (14) have a common outer connection port (18).

3. The cylinder as recited in claim 1, wherein the mentioned transfer port (17) is located somewhat higher than the corresponding connecting port (16).

4. The cylinder as recited in claim 3, wherein the inlet pipe (10) is directed obliquely downwards towards a crank case (2) of the engine.

5. The cylinder as recited in claim 3, wherein the outer connecting port (18) is positioned essentially perpendicularly to the cylinder (1).

6. The cylinder as recited in claim 1, wherein the outer connecting port (18) is positioned essentially perpendicularly to the cylinder (1).

7. The cylinder as recited in claim 1, wherein the inlet pipe (10) is directed obliquely downwards towards a crank case (2) of the engine.

8. The cylinder as recited in claim 7, wherein the outer connecting port (18) is positioned essentially perpendicularly to the cylinder (1).

9. The cylinder as recited in claim 1, wherein the at least one connecting port (16) communicates said connection of the outer connecting port (18) to the transfer port (17) through the piston-ported air passage (11).

10. A cylinder arrangement for a two-stroke, crankcase scavenged internal combustion engine, said cylinder arrangement comprising:

a cylinder defined by a peripheral cylinder wall and adapted for accommodating a reciprocating piston therein;

a wall passage extending from an air inlet port, said air inlet port being located exteriorly to said cylinder wall, said wall passage extending at least partially obliquely upwards and through said cylinder wall to an air connecting port located interiorly to said cylinder wall, said wall passage providing a fluid flow passage across said cylinder wall and said wall passage being laterally located with respect to said air-fuel inlet pipe; and an air-fuel inlet pipe directed at least partially obliquely downwards and through said cylinder wall.

11. The cylinder arrangement as recited in claim 10, wherein at least a portion of said air inlet port is oriented substantially perpendicularly to said cylinder.

12. A cylinder arrangement for a two-stroke, crankcase scavenged internal combustion engine, said cylinder arrangement comprising:

a cylinder defined by a peripheral cylinder wall and adapted for accommodating a reciprocating piston therein;

a wall passage extending from an air inlet port, said air inlet port being located exteriorly to said cylinder wall, said wall passage extending at least partially obliquely upwards and through said cylinder wall to an air connecting port located interiorly to said cylinder wall, said wall passage providing a fluid flow passage across said cylinder wall and said said wall passage being divided into a plurality of wall passages, each of said plurality of wall passages laterally located with respect to said air-fuel inlet pipe; and an air-fuel inlet pipe directed at least partially obliquely downwards and through said cylinder wall.

13. The cylinder arrangement as recited in claim 12, wherein said plurality of wall passages is established by a partition located between at least two of said plurality of wall passages.

14. A cylinder arrangement for a two-stroke, crankcase scavenged internal combustion engine, said cylinder arrangement comprising:

a cylinder defined by a peripheral cylinder wall and adapted for accommodating a reciprocating piston therein;

a wall passage extending from an air inlet port, said air inlet port being located exteriorly to said cylinder wall, at least partially obliquely upwards and through said cylinder wall to an air connecting port located interiorly to said cylinder wall, said wall passage providing a fluid flow passage across said cylinder wall, and wherein said wall passage is partitioned into a plurality of wall passages, each of said wall passages extending at least partially obliquely upwards and through said cylinder wall.

15. A cylinder arrangement for a two-stroke, crankcase scavenged internal combustion engine, said cylinder arrangement comprising:

a cylinder defined by a peripheral cylinder wall and adapted for accommodating a reciprocating piston therein;

a wall passage extending from an air inlet port, said air inlet port being located exteriorly to said cylinder wall, at least partially obliquely upwards and through said cylinder wall to an air connecting port located interiorly to said cylinder wall, said wall passage providing a fluid flow passage across said cylinder wall; and a transfer port fluidly connectable to said air connecting port via a piston-ported air passage.

16. The cylinder arrangement as recited in claim 15, further comprising:

said piston-ported air passage being formed in a piston located within said cylinder for reciprocating motion therein.

17. A cylinder arrangement for a two-stroke, crankcase scavenged internal combustion engine, said cylinder arrangement comprising:

a cylinder defined by a peripheral cylinder wall and adapted for accommodating a reciprocating piston therein; and a pair of air inlet wall passages extending at least partially obliquely upwards and through said cylinder wall, one each of said pair of air inlet wall passages being located on either side of an air-fuel inlet pipe.

* * * * *